US006074075A

United States Patent [19]

Staniec

[11] Patent Number: 6,074,075

[45] Date of Patent: Jun. 13, 2000

[54] CENTERING DEVICE FOR HIGH MAST LIGHTING SYSTEM

[75] Inventor: Theodore Staniec, Des Plaines, Ill.

[73] Assignee: JJI Lighting Group, Inc., Greenwich, Conn.

[21] Appl. No.: 09/052,964

[22] Filed: Apr. 1, 1998

[51] Int. Cl.[7] ..... F21V 21/36

[52] U.S. Cl. ..... 362/250; 362/402; 362/403; 362/390; 362/431

[58] Field of Search ..... 362/249, 250, 362/419, 431, 403, 286, 390, 369, 385, 402

[56] References Cited

U.S. PATENT DOCUMENTS

| | | | |
|---|---|---|---|
| 3,696,241 | 10/1972 | Meyer et al. | 362/250 |
| 3,805,054 | 4/1974 | Wolf | 362/250 |
| 4,237,530 | 12/1980 | Murray et al. | 362/431 |
| 4,348,717 | 9/1982 | Thompson | 362/403 |
| 4,429,355 | 1/1984 | Garchinsky | 362/250 |
| 4,661,894 | 4/1987 | Chenot | 362/250 |

*Primary Examiner*—Thomas M. Sember
*Attorney, Agent, or Firm*—Fitzpatrick, Cella, Harper & Scinto

[57] ABSTRACT

A high mast lighting system includes an elongated vertical mast having upper and lower ends, an annular lamp support ring surrounding the mast and having a plurality of lamps removably mounted thereon, a mechanism for raising and lowering the ring along the mast between the upper and lower ends, and a centering device for centering the ring on the mast when moved by the moving mechanism between the upper and lower positions. The centering device includes a plurality of resilient members equally spaced around the inner circumference of the ring and paired with a plurality of contact members. Each resilient member is secured to two locations on the inner circumference of the ring and spans the inner circumference of the ring so as to form a substantially linear chord when the ring is centered on the mast. Each contact member resiliently contacts the mast with a centering force.

56 Claims, 5 Drawing Sheets

CENTERING DEVICE FOR HIGH MAST LIGHTING SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to high mast lighting systems such as are used on highways and at toll plazas.

High mast lighting systems include a vertically elongated central mast or pole surrounded by an annular ring or other shaped platform on which a plurality of light fixtures are mounted. The annular ring is adapted to be raised to the top of the mast and supported there in a locked position during use. A drive mechanism is provided to lower the ring to the base of the mast in order to facilitate maintenance and lamp changes. Typically, the support rings in high mast lighting systems are raised and lowered by the drive mechanism through a plurality of cables secured to the ring and passing downwardly from pulleys on top of the mast into the ring to the drive mechanism.

High mast lighting systems can attain great height, of over 100 feet or more, with the result that they are subjected to severe stresses, particularly during heavy weather. Further, such high masts are not necessarily perfectly circular nor straight throughout their length. Some warping or bending may occur. Moreover, in cold weather ice may form on the mast. Although the support ring is typically secured from unintended movement when at its uppermost position on the mast, it is also imperative that the support ring not impact against the mast when it is raised and lowered between the upper and lower positions, whether it be due to high winds or warping or icing of the mast. It is also important that the ring ride smoothly along the mast while it is raised and lowered so as not to put undue stress on the cables and the driving mechanism.

2. Description of the Related Art

A variety of different types of centering devices for high mast lighting systems have been proposed.

For example, U.S. Pat. No. 4,025,782 describes providing the ring with a plurality of radially inwardly directed arms, each terminating in a roller. However, no spring biasing is described and it is not clear how effective this structure will be if the mast is warped or high winds interfere with the raising or lowering of the ring.

U.S. Pat. No. 4,661,894 discloses a stabilizing device for a high mast lighting system in which the weight of the support ring is converted into a stabilizing and centering force applied to a plurality of stabilizing arms. The tension in the cables pivot the arms toward and into engagement with the mast so as to maintain a constant biasing force exerted by the arms and its associated rollers against the mast. This, however, is a complicated structure.

U.S. Pat. Nos. 4,228,488 and 4,429,355 disclose a raising and lowering system for a high mast lighting system in which the ascent and descent of the ring is stabilized by a plurality of stabilizing rollers mounted on elongated axles. The elongated axles are apparently resilient. However, these axles do not surround the mast and it is possible that under high wind conditions the rollers can slide out of engagement with the mast so as to disrupt the ascent or descent of the ring.

U.S. Pat. No. 4,092,707 discloses a high mast lighting system provided with a plurality of stabilizer arms connected to the support ring by parallel links. Through a series of cables, pulleys and springs, the stabilizer arms are urged into engagement with the mast due to the weight of the ring. This, too, is a complicated structure.

U.S. Pat. No. 3,805,054 discloses a high mast lighting system in which rollers are mounted on telescopic arms that are spring biased into engagement with the mast. Should the hoist cable fail during movement of the lighting rack, the guides can slow descent considerably due to the pressure exerted by the compression spring.

U.S. Pat. No. 4,348,717 discloses a high mast lighting system in which the ring is centered by a plurality of U-shaped guide arms, each having a roller at its center for engaging the mast. Coil springs are arranged on the ends of the guide arms to torsionally urge the rollers toward the axis of the support ring and into contact with the surface of the mast. However, this is a complex and relatively heavy solution to the problem of centering the light ring. Further, it is difficult to pretension the torsion springs with a sufficient torque when mounting the ring on the mast.

BRIEF SUMMARY OF THE INVENTION

While the above-described devices have been generally satisfactory in use, it is an object of the present invention to provide an improved centering device, which is simple in construction, yet provides effective centering.

Another object of the present invention is to provide a centering device that can be easily attached to the support ring in the field.

Yet another object of the present invention is to provide a relatively lightweight centering device, so as not to needlessly increase the overall weight of the support ring.

According to one aspect of the present invention, a high mast lighting system includes an elongated vertical mast having upper and lower ends, an annular lamp support ring surrounding the mast and having a plurality of lamps removably mounted thereon, means for raising and lowering the ring along the mast between the upper and lower ends, and a centering device for centering the ring on the mast when moved by the moving means between the upper and lower positions. The centering device includes a plurality of resilient members equally spaced around the inner circumference of the ring and paired with a plurality of contact members, each resilient member being secured to two locations on the inner circumference of the ring and spanning the inner circumference of the ring so as to form a substantially linear chord when the ring is centered on the mast, each contact member resiliently contacting the mast with a centering force.

According to another aspect of the present invention, a centering device is provided for a high mast lighting system including an elongated vertical mast surrounded by an annular lamp support ring, the support ring having a plurality of lamps removably mounted thereon, the support ring being movable between upper and lower ends of the mast. The centering device is for centering the ring on the mast when moved between the upper and lower ends of the mast. The centering device according to this aspect includes a plurality of resilient members equally spaced around the inner circumference of the ring, each resilient member being secured to two locations on the inner circumference of the ring and spanning the inner circumference of the ring so as to form a substantially linear chord when the ring is centered on the mast, and a plurality of contact members respectively paired with the resilient members. Each contact member resiliently contacts the mast with a centering force.

According to a further aspect of the present invention, a high mast lighting system includes an elongated vertical mast having upper and lower ends, an annular lamp support ring surrounding the mast and having a plurality of lamps removably mounted thereon, means for raising and lowering the ring along the mast between the upper and lower ends, and a centering device for centering the ring on the mast when moved by the moving means between the upper and lower positions. The centering device comprises a plurality of tension spring units equally spaced around the inner circumference of the ring, each spring unit being secured to two locations on the inner circumference of the ring and spanning the inner circumference of the ring. The center of each spring unit resiliently contacts the mast with a centering force.

According to a still further aspect of the present invention, a centering device is provided for a high mast lighting system including an elongated vertical mast surrounded by an annular lamp support ring, the support ring having a plurality of lamps removably mounted thereon, the support ring being movable between upper and lower ends of the mast. The centering device is for centering the ring on the mast when moved between the upper and lower ends of the mast. The centering device according to this aspect includes a plurality of tension spring units equally spaced around the inner circumference of the ring, each spring unit being secured to two locations on the inner circumference of the ring and spanning the inner circumference of the ring. The center of each spring unit resiliently contacts the mast with a centering force.

According to yet another aspect of the present invention, a high mast lighting system includes an elongated vertical mast having upper and lower ends, an annular lamp support ring surrounding the mast and having a plurality of lamps removably mounted thereon, means for raising and lowering the ring along the mast between the upper and lower ends, and a centering device for centering the ring on the mast when moved by the moving means between the upper and lower positions. The centering device comprises a plurality of resilient means, each resilient means for generating tension between two locations on the inner circumference of the ring and applying a centering force toward the mast.

According to a still further aspect of the present invention, a centering device is provided for a high mast lighting system including an elongated vertical mast surrounded by an annular lamp support ring, the support ring having a plurality of lamps removably mounted thereon, the support ring being movable between upper and lower ends of the mast. The centering device is for centering the ring on the mast when moved between the upper and lower ends of the mast. The centering device according to this aspect includes a plurality of resilient means, each resilient means for generating tension between two locations on the inner circumference of the ring and applying a centering force toward the mast, and means for securing the resilient means to the ring.

The above, and other objects, features and advantages of the present invention will be apparent from the following detailed description of an illustrative embodiment thereof, which is to be read in connection with the accompanying drawings wherein:

DETAILED DESCRIPTION OF THE INVENTION

Figure 1:
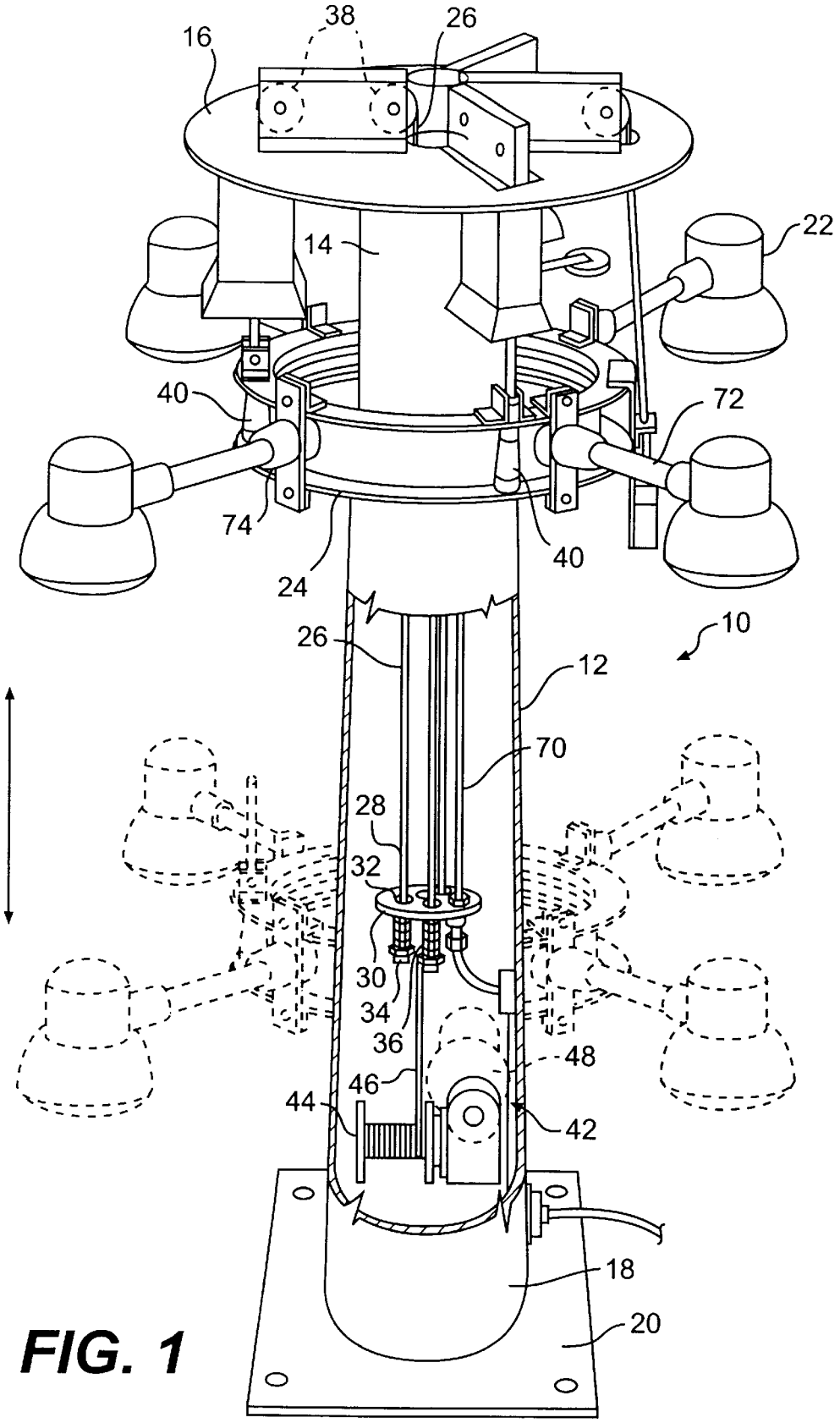
FIG. 1 is a perspective view, showing the high mast lighting system of the present invention with the lamp support ring shown in solid lines in its upper position and in dotted lines in its lower position.

Referring now to the drawings in detail, and initially to FIG. 1 thereof, a high mast lighting system 10 constructed in accordance with the present invention is illustrated. The lighting system includes a generally conventional elongated hollow support mast 12 formed of steel, aluminum, or the like, in a conventional manner. The mast 12 includes an upper end 14 to which a support platform 16 is rigidly mounted. The lower end 18 of the mast is secured on a foundation (not shown) by a mounting base structure 20, or the like, in any convenient manner.

A plurality of light fixtures 22 are mounted on an annular support ring 24 which surrounds the mast 12. The support ring is raised and lowered through a plurality of cables 26.

Cables 26 have lower ends 28 which are secured to a drive disk 30, or the like. Preferably, the cables pass through apertures 32 in disk 30 to ferrules or stop structures 34 at their ends. Springs 36 are secured between the plate 30 and the ferrules 34 to provide some cushioning in the system during raising and lowering operations. Cables 26 are trained or guided over a plurality of guide rollers 38, or the like, mounted on the support platform 16. These rollers may be in the form of pulleys or conventional rollers having flat surfaces, as desired. The particular number, shape and form of these rollers form no part of the invention. The upper ends of cables 26 are rigidly secured to support ring 24 by ferrules 40, or the like, in a conventional manner, as would be understood by those skilled in the art.

Support ring 24 is raised and lowered by a drive mechanism 42 in the base of the mast. The drive mechanism includes a winch 44 to which a drive cable 46 is secured. Drive cable 46 is wound and unwound from the winch 44 by an electric motor 48, or the like. Preferably, electric motor 48 is removable from drive mechanism 42 in a known manner so that it does not remain in the open or available for operation except when a maintenance crew brings it to the site and engages it with the drive mechanism.

The upper end of cable 46 is secured in any convenient manner to drive disk 30. When the drive motor 48 is operated to wind the cable 46 on the winch 44 cables 26 are lowered in the mast causing the ring to rise from the dotted line position in FIG. 1 to its uppermost position. When motor 48 is operated in the opposite direction to release cable 46 from the winch, cables 26 are allowed to rise in the mast under the influence of the weight of the ring which is then lowered to its dotted line position.

Electrical power is supplied to lamps 22 through an electrical cable 70 located within mast 12. Electrical cable 70 passes upwardly through the mast to a series of rollers (not shown) which guide the cable from the mast to a junction box from which electrical wiring (not shown) is guided in the channel of ring 24 to support poles 72 of lamps 22.

Figure 2:
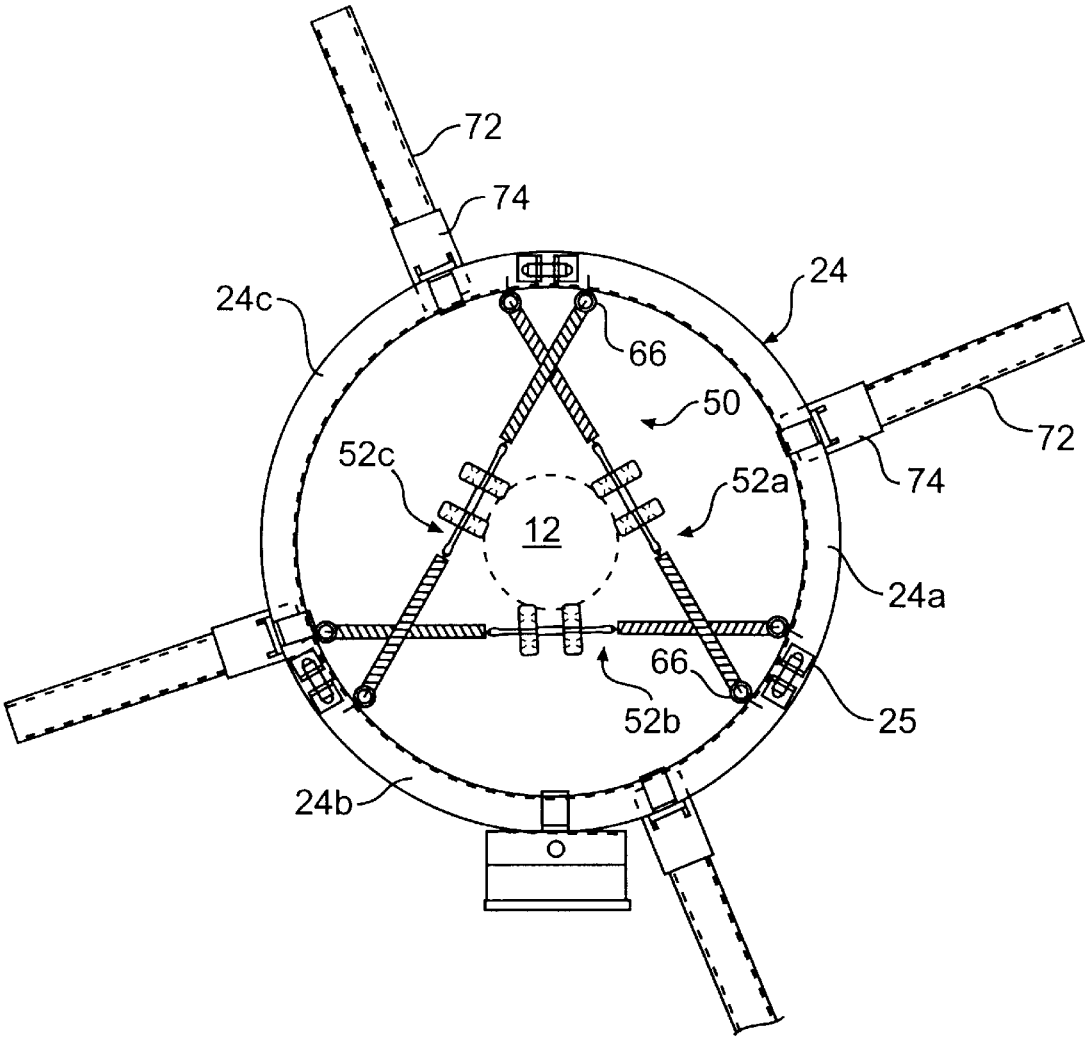
FIG. 2 is a partial plan view of the lamp support ring and the centering device of the present invention.

Lamps 22 are of generally conventional construction, and are secured on the outer ends of arms 72. Those arms extend generally radially from the support ring, as seen in FIGS. 1 and 2. The inner ends of the support arms 66 are mounted in sockets 74, shown in FIGS. 1 and 2. These sockets each have an interior cylindrical receptacle into which its associated pole 72 extends. The pole is held in place by one or more set screws (not shown).

In accordance with an aspect of the present invention, one embodiment of a centering device 50 of the present invention is shown in FIG. 2. The centering device 50 includes a series of spring units 52*a*–52*c* connected to the inner circumference of the support ring 24. In the shown embodiment, three spring units are used and generally form an equilateral triangle. However, the present invention is not intended to be limited to this number. Any number of spring units greater than three can be used. It is preferred, however, that at least three spring units be used so as to completely surround the mast 12.

Figure 3:
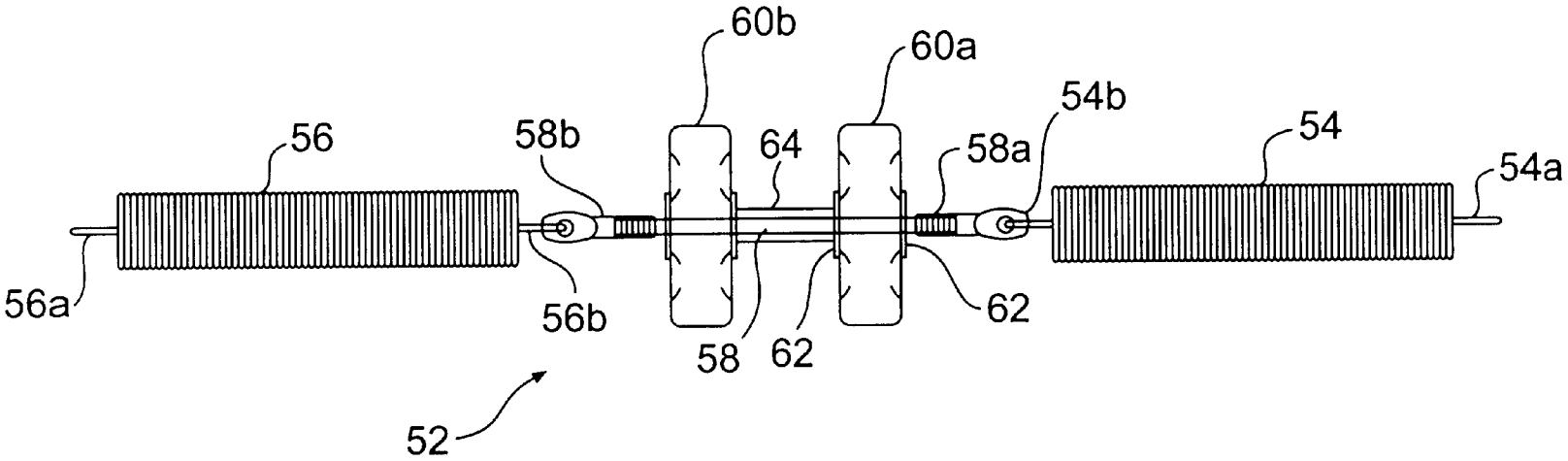
FIG. 3 is a plan view of a centering spring and roller arrangement of the centering device of the present invention.

Referring to FIG. 3, an individual spring unit 52 of the first embodiment will be described. Each spring unit includes first and second helical tension springs 54, 56. Each tension spring 54, 56 has a hook 54*a*, 54*b*, 56*a*, 56*b* on either end. One of the hooks 54*a*, 56*a* of each tension spring 54, 56 is secured to the inner circumference of the support ring 24, and the other hook 54*b*, 56*b* is attached to a roller shaft 58. The roller shaft 58 can be formed as a main shaft with a cap 58*a*, 58*b* threaded onto either end. Each cap 58*a*, 58*b* includes an eye for receiving the inner hook 54*b*, 56*b* of each tension spring 54, 56. Alternatively, the roller shaft 58 can be formed as a unitary member with eye holes formed in its ends.

At least one roller is journalled onto the roller shaft so as to be freewheeling. In the preferred embodiment, two spaced rollers 60*a*, 60*b* are provided on the roller shaft 58 to securely engage the mast 12. In the shown embodiment, the rollers are maintained at their axial positions on the roller shaft by lock washers 62. A spacer 64 can be provided between the rollers 60*a*, 60*b* to maintain the desired spacing. The rollers can be formed of any desired material, but are preferably formed of a soft, flexible material, such as rubber, so they can smoothly roll on the support mast and not impact thereagainst.

Referring again to FIG. 2, the support ring 24 can be formed as several separate components. In the shown embodiment, the support ring 24 is formed of three partial arcs 24*a*–24*c*. The three arcs 24*a*–24*c* can be secured together in any known manner, such as by mating brackets bolted together as generally shown at 25 in FIG. 2. Of course, the support ring 24 can be formed as an integral unit, if desired.

Two eye bolts 66 are secured to the support ring 24 for each spring unit 52. The outer hook 54*a*, 56*a* of each tension spring is hooked to one eye bolt 66 so as to secure the spring unit 52 to the support ring 24. Each spring unit 52 connected to a pair of eye bolts 66 of the support ring 24 forms a substantially linear chord of the inner periphery of the support ring 24 when the support ring is centered on the mast at its upper end 14. Masts of this type typically are tapered with the larger diameter at the lower end 18. Thus, when the support ring 24 is at the lower end of the mast 12, the rollers 60*a*, 60*b* are displaced further radially than when at the upper end, and a linear chord is not formed.

It is preferable that the linear chords, which are formed by the spring units 52 when the supporting ring 24 is at the upper end of the mast 12, overlap so as to constrain movement of the support ring relative to the support mast. That is, when three spring units are employed, by overlapping the chords formed by the spring units the enclosed area shaped as an equilateral triangle defined by the chords is lessened.

Figure 4:
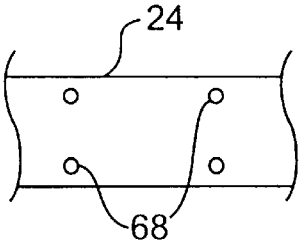
FIG. 4 is a partial elevational view of the lamp support ring of the present invention.

Because the chords defined by the spring units overlap, adjacent spring units 52 cannot be aligned in the same plane. Accordingly, a series of upper and lower anchor holes 68 are formed in the support ring 24 as shown in FIG. 4. For adjacent vertical pairs of anchor holes 68, one eye bolt 66 is secured to an upper hole of one pair and the adjacent eye bolt is secured to the lower hole of the adjacent pair. Each spring unit 52 is, therefore, secured to either two upper-disposed eye bolts, two lower-disposed eye bolts, or one upper- and one lower-disposed eye bolt, so they will not interfere with one another.

The tension springs 54, 56 of each spring unit 52 are formed of known materials and specifications so as to create a desired tension when stretched between two eye bolts 66. Preferably the materials are corrosion-resistant, since the spring units 52 may be exposed to the elements. The tension in the spring units should be designed so as to generate a radial force directed at the center of the mast 12 at least when the support ring 24 moves relative to the mast in directions transverse to the axis of the mast. This radial force must be sufficient to counteract the inertia forces of the support ring 24, regardless of whether the support ring is moved by wind or warping of the mast. Thus, the characteristics of the tension springs 54, 56 of the spring units 52 are dependent upon the mass of the support ring 24.

In accordance with the present invention, the centering device 50 can maintain the support ring 24 centered on the mast, especially during movement between its upper and lower positions, so as to avoid undesirable interference of the support ring 24 and its associated parts with the mast. Such interference can be caused by winds, warping of the mast, ice on the mast, or other conditions. If the support ring 24 is in its upper position, and lowered, the rollers 60*a*, 60*b* of the centering device 50 will be maintained in contact with the mast 12 even as its diameter increases towards its base. Any warping or icing of the mast will not interfere with the movement of the rollers 60*a*, 60*b* because each roller pair can independently move radially inward or outward to accommodate such defects.

Further, should the support ring 24 be urged towards the mast 12 due to high winds, the spring units 52 will allow some movement, but will prevent the support ring 24 from contacting and impacting against the mast, thus avoiding shock to the lighting. After the external force subsides, the spring units 52 will once more center the support ring 24 on the mast 12.

Importantly, because the spring units 52 totally surround the mast 12, there is no possibility of the mast unit moving outside of the centering device 50.

Figure 5:
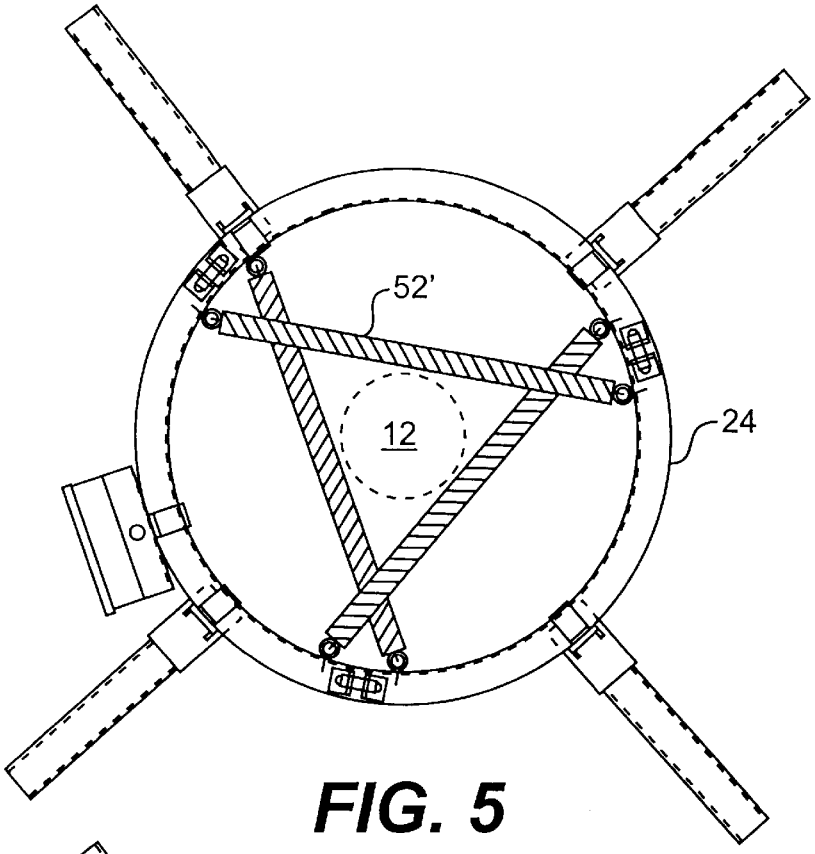
FIG. 5 is a top plan view of the lamp support ring of a second embodiment of the present invention.

The guide rollers 60*a*, 60*b* allow for smooth movement of the support ring 24 along the length of the mast 12. However, these guide rollers are not necessary to achieve the centering and shock absorbing effects of the present invention. In the second embodiment, shown in FIG. 5, no guide rollers are used and each spring unit 52' is comprised of a single tension spring. These tension springs are disposed within the interior of the support ring 24 in a similar manner as in the first embodiment. The springs themselves can contact the surface of the mast to achieve the desired centering and shock absorbing effects. To minimize the friction between the springs and the mast 12, the springs can be formed of or coated with a material having self-lubricating properties.

Figure 6:
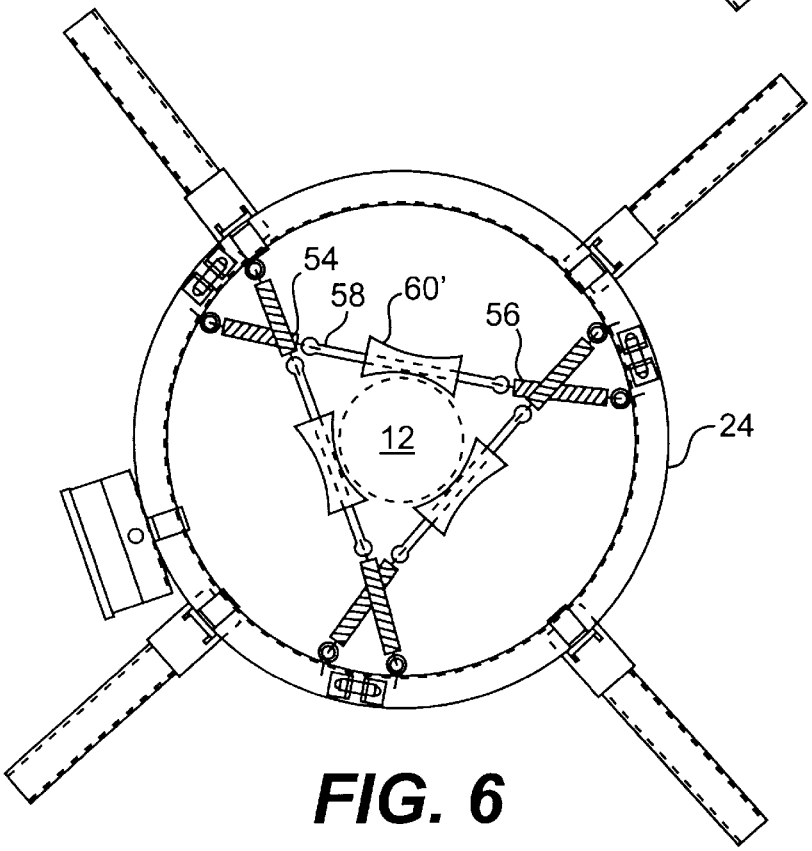
FIG. 6 is a top plan view of the lamp support ring of a third embodiment of the present invention.

In the third embodiment, shown in FIG. 6, each roller pair of each spring unit of the first embodiment is replaced with a single roller 60'. In order to enhance the centering capabilities of these rollers and ensure they remain in contact with the mast 12, their sides are preferably formed with a curvature complementary to the curvature of the mast 12.

Figure 7:
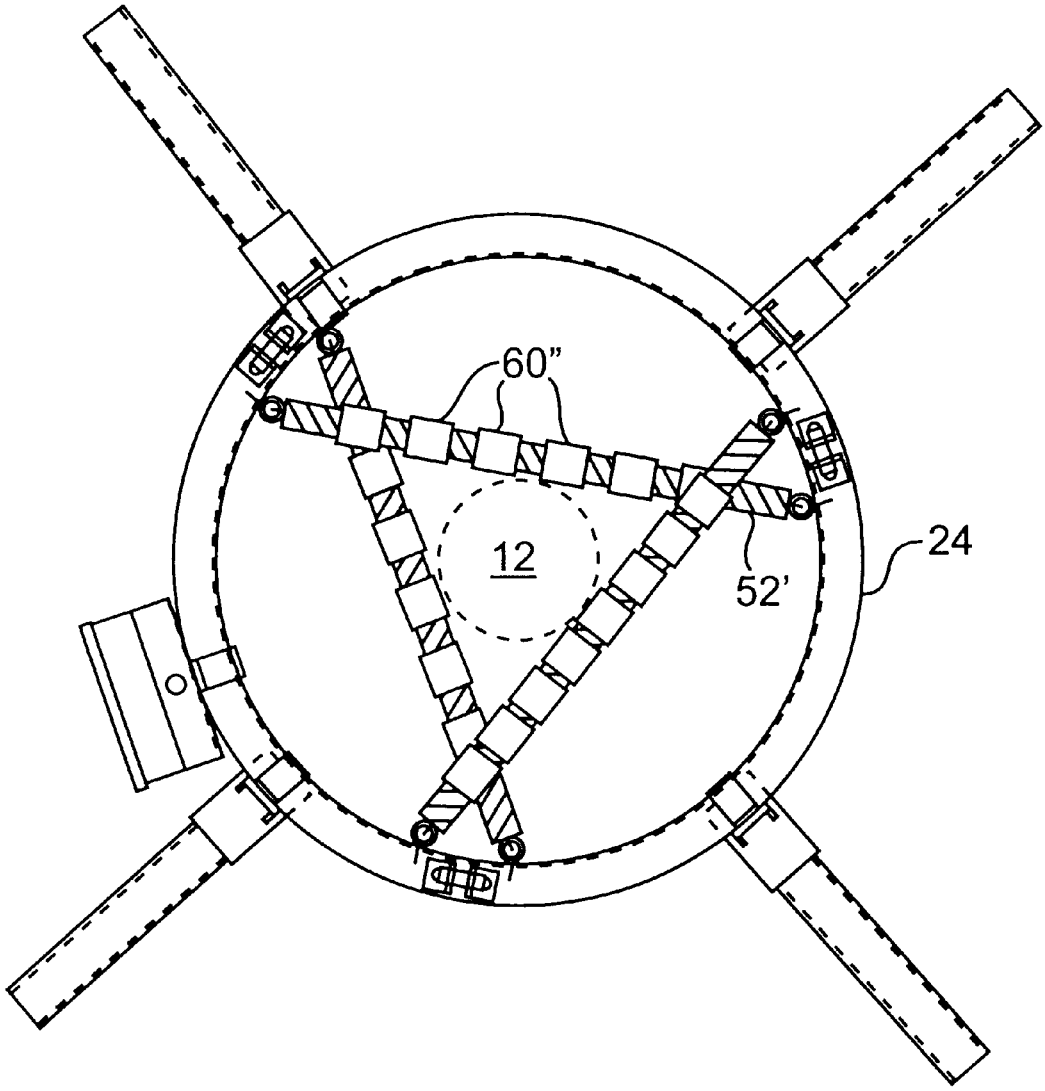
FIG. 7 is a top plan view of the lamp support ring of a third embodiment of the present invention.

In the fourth embodiment shown in FIG. 7, a single tension spring for each spring unit 52' is used, similarly to the second embodiment shown in FIG. 4. However, a plurality of rollers 60" are provided surrounding each tension spring. The tension spring serves as an axis for the rollers, which can spin freely thereon. Because the rollers 60" are formed as a plurality of discrete elements, they can bend to accommodate the curvature of the mast 12.

Although illustrative embodiments of the present invention have been described herein in connection with the accompanying drawings, it is to be understood that this invention is not limited to those precise embodiments and that various changes and modifications may be effected therein by those skilled in the art without departing from the spirit of this invention.

What is claimed is:

1. A high mast lighting system comprising:

an elongated vertical mast having upper and lower ends;

an annular lamp support ring surrounding said mast and having a plurality of lamps removably mounted thereon;

means for raising and lowering said ring along said mast between the upper and lower ends; and a centering device for centering said ring on said mast when moved by said moving means between the upper and lower positions, said centering device comprising a plurality of resilient tension members equally spaced around the inner circumference of said ring and paired with a plurality of contact members, each resilient member being secured in tension to two locations on the inner circumference of said ring and spanning the inner circumference of said ring so as to form a substantially linear chord when said ring is centered on said mast, with each contact member contacting and being biased against said mast with a centering force formed by the tension in said resilient tension members.

2. A high mast lighting system according to claim 1, wherein said centering device comprises at least three resilient members.

3. A high mast lighting system according to claim 2, wherein each resilient member comprises an elongated tension spring extending longitudinally between the two locations on the inner circumference of the ring to which it is connected.

4. A high mast lighting system according to claim 3, wherein each tension spring comprises an elongated helical coil spring.

5. A high mast lighting system according to claim 3, wherein each contact member comprises at least one roller supported in the center of said tension spring, said at least one roller contacting said mast with the centering force.

6. A high mast lighting system according to claim 3, wherein each resilient tension member comprises a pair of elongated tension springs and each contact member comprises at least one roller centrally supported at least one end of said pair of tension springs, said at least one roller contacting said mast with the centering force and each said pair of elongated tension springs being secured at their ends opposite said at least one roller to the two locations on the inner circumference of the ring.

7. A high mast lighting system according to claim 6, wherein a pair of said rollers is supported by said pair of tension springs.

8. A high mast lighting system according to claim 7, wherein said rollers are spaced apart and journalled onto a roller shaft, each end of said roller shaft being secured to a respective one of said pair of springs.

9. A high mast lighting system according to claim 1, wherein each resilient member comprises a tension spring and each contact member comprises an outer surface of said spring.

10. A centering device for a high mast lighting system, the lighting system including an elongated vertical mast surrounded by an annular lamp support ring, the support ring having a plurality of lamps removably mounted thereon, the support ring being movable between upper and lower ends of the mast, said centering device centering the ring on the mast when moved between the upper and lower ends of the mast, said centering device comprising:

a plurality of elongated resilient tension members equally spaced around the inner circumference of the ring, each resilient tension member being secured to two locations on the inner circumference of the ring and spanning the inner circumference of the ring so as to form a substantially linear chord when the ring is centered on the mast; and a plurality of contact members respectively paired with said resilient members, each contact members resiliently contacting and being biased against the mast with a centering force formed by the tension in said elongated resilient tension members.

11. A centering device according to claim 10, comprising at least three of said resilient members.

12. A centering device according to claim 11, wherein each resilient member comprises an elongated tension spring extending longitudinally between the two locations on the inner circumference of the ring to which it is connected.

13. A centering device according to claim 12, wherein said tension spring comprises a helical coil spring.

14. A centering device according to claim 11, wherein each contact member comprises at least one roller supported in the center of said tension spring, said at least one roller contacting the mast with the centering force.

15. A centering device according to claim 10, wherein each resilient tension member comprises a pair of elongated tension springs and each contact member comprises at least one roller centrally supported at one end to each of said pair of tension springs, said at least one roller contacting the mast with the centering force and each said pair of elongated tension springs being secured at their ends opposite said at least one roller to the two locations on the inner circumference of the ring.

16. A centering device according to claim 15, wherein a pair of rollers is supported by said pair of tension springs.

17. A centering device according to claim 16, wherein said rollers are spaced apart and journalled onto a roller shaft, each end of said roller shaft being secured to a respective one of said pair of springs.

18. A centering device according to claim 10, wherein each resilient member comprises a tension spring and each contact member comprises an outer surface of said spring.

19. A high mast lighting system comprises:

an elongated vertical mast having upper and lower ends;

an annular lamp support ring surrounding said mast and having a plurality of lamps removably mounted thereon;

means for raising and lowering said ring along said mast between the upper and lower ends; and a centering device for centering said ring on said mast when moved by said moving means between the upper and lower positions, said centering device comprising a plurality of elongated tension spring units equally spaced around the inner circumference of said ring, each elongated tension spring unit being secured to two locations on the inner circumference of said ring and spanning the inner circumference of said ring, the center of each elongated tension spring unit resiliently contacting said mast with a centering force formed by the tension in said spring unit.

20. A high mast lighting system according to claim 19, wherein said centering device comprises at least three elongated tension spring units.

21. A high mast lighting system according to claim 19, wherein each elongated tension spring unit comprises a single tension spring.

22. A high mast lighting system according to claim 21, wherein each said tension spring comprises a helical coil tension spring.

23. A high mast lighting system according to claim 21, wherein each tension spring spans the inner circumference of said ring so as to form a substantially linear chord when said ring is centered on said mast.

24. A high mast lighting system according to claim 19, wherein each elongated tension spring unit comprises at least one roller supported in the center of a tension spring, said roller contacting said mast with the centering force formed by the tension in the elongated tension spring units.

25. A high mast lighting system according to claim 19, wherein each spring unit comprises at least one roller centrally supported by a pair of elongated tension springs, said roller contacting said mast with the centering force formed by the tension in the elongated tension springs.

26. A high mast lighting system according to claim 25, wherein a pair of rollers is supported by said pair of tension springs.

27. A high mast lighting system according to claim 26, wherein said rollers are spaced apart and journalled onto a roller shaft, each end of said roller shafts being secured to a respective one of said pair of springs.

28. A high mast lighting system according to claim 27, wherein said pair of springs and said roller shaft of each spring unit span the inner circumference of said ring so as to form a substantially linear chord when said ring is centered on said mast.

29. A centering device for a high mast lighting system, the lighting system including an elongated vertical mast surrounded by an annular lamp support ring, the support ring having a plurality of lamps removably mounted thereon, the support ring being movable between upper and lower ends of the mast, said centering device centering the ring on the mast when moved between the upper and lower ends of the mast, said centering device comprising:

a plurality of elongated tension spring units equally spaced around the inner circumference of the ring, each spring unit being secured to two locations on the inner circumference of the ring and spanning the inner circumference of the ring, the center of each spring unit resiliently contacting the mast with a centering force formed by the tension in the elongated tension spring units.

30. A centering device according to claim 29, comprising at least three of said spring units.

31. A centering device according to claim 29, wherein each spring unit comprises an elongated tension spring.

32. A centering device according to claim 31, wherein said tension coil spring comprises a helical spring.

33. A centering device according to claim 31, wherein each tension spring spans the inner circumference of the ring so as to form a substantially linear chord when the ring is centered on the mast.

34. A centering device according to claim 29, wherein each spring unit comprises at least one roller supported in the center of a tension spring, said roller contacting the mast with the centering force formed by the tension in the elongated tension springs.

35. A centering device according to claim 29, wherein each spring unit comprises at least one roller centrally supported by a pair of tension springs, said roller contacting the mast with the centering force formed by the tension in the elongated tension springs.

36. A centering device according to claim 35, wherein a pair of rollers is supported by said pair of tension springs.

37. A centering device according to claim 36, wherein said rollers are spaced apart and journalled onto a roller shaft, each end of said roller shaft being secured to a respective one of said pair of springs.

38. A centering device according to claim 37, wherein said pair of springs and said roller shaft of each spring unit span the inner circumference of the ring so as to form a substantially linear chord when the ring is centered on the mast.

39. A high mast lighting system comprising:

an elongated vertical mast having upper and lower ends;

an annular lamp support ring surrounding said mast and having a plurality of lamps removably mounted thereon;

means for raising and lowering said ring along said mast between the upper and lower ends; and a centering device for centering said ring on said mast when moved by said moving means between the upper and lower positions, said centering device comprising a plurality of resilient means for generating tension, each said resilient means being respectively connected between two selected locations on the inner circumference of said ring and contacting the mast for applying a centering force toward said mast formed by the tension in the resilient means.

40. A high mast lighting system according to claim 39, wherein said centering device comprises three elongated resilient tension means equally spaced around the inner circumference of said ring.

41. A high mast lighting system according to claim 39, wherein each resilient means comprises an elongated tension spring.

42. A high mast lighting system according to claim 41, wherein said tension spring comprises a helical coil spring.

43. A high mast lighting system according to claim 39, wherein said resilient means generates the tension along a substantially linear chord when said ring is centered on said mast.

44. A high mast lighting system according to claim 39, wherein each resilient means comprises at least one roller supported in the center of a tension spring, said roller contacting said mast with the centering force.

45. A high mast lighting system according to claim 39, wherein each resilient means comprises at least one roller centrally supported by a pair of tension springs, said roller contacting said mast with the centering force.

46. A high mast lighting system according to claim 45, wherein a pair of rollers is supported by said pair of tension springs.

47. A high mast lighting system according to claim 46, wherein said rollers are spaced apart and journalled onto a roller shaft, each end of said roller shaft being secured to a respective one of said pair of springs.

48. A centering device for a high mast lighting system, the lighting system including an elongated vertical mast surrounded by an annular lamp support ring, the support ring having a plurality of lamps removably mounted thereon, the support ring being movable between upper and lower ends of the mast, said centering device for centering the ring on the mast when moved between the upper and lower ends of the mast, said centering device comprising:

a plurality of resilient means for generating tension between a plurality of pairs of locations on the inner circumference of the ring and contacting the mast tangentially for applying a centering force toward the mast formed by the tension in the resilient means; and means for securing said resilient means to the ring.

49. A centering device according to claim 48, comprising at least three resilient means.

50. A centering device according to claim 48, wherein each resilient means comprises an elongated tension spring.

51. A centering device according to claim 50, wherein said tension coil spring comprises a helical spring.

52. A centering device according to claim 48, wherein said resilient means generates the tension along a substantially linear chord when the ring is centered on the mast.

53. A centering device according to claim 48, wherein each resilient means comprises at least one roller supported in the center of a tension spring, said roller contacting the mast with the centering force.

54. A centering device according to claim 48, wherein each resilient means comprises at least one roller centrally supported by a pair of tension springs, said roller contacting the mast with the centering force.

55. A centering device according to claim 54, wherein a pair of rollers is supported by said pair of tension springs.

56. A centering device according to claim 55, wherein said rollers are spaced apart and journalled onto a roller shaft, each end of said roller shaft being secured to a respective one of said pair of springs.

* * * * *